United States Patent [19]

Fischer

[11] Patent Number: 4,559,032

[45] Date of Patent: Dec. 17, 1985

[54] MULTI-SHEET ROTARY FOLDING APPARATUS, PARTICULARLY FOR ASSOCIATION WITH ROTARY PRINTING MACHINES

[75] Inventor: Hermann Fischer, Augsburg, Fed. Rep. of Germany

[73] Assignee: M.A.N.-Roland Druckmaschinen Aktiengesellschaft, Augsburg, Fed. Rep. of Germany

[21] Appl. No.: 447,521

[22] Filed: Dec. 7, 1982

[30] Foreign Application Priority Data

Dec. 22, 1981 [DE] Fed. Rep. of Germany ..... 3151283

[51] Int. Cl.[4] ..... B65H 45/16; B41F 13/56

[52] U.S. Cl. ..... 493/432; 270/21.1; 270/41; 271/82; 493/232; 493/359

[58] Field of Search ..... 493/432, 232, 237, 229, 493/254, 359, 357, 356, 458; 271/82; 270/21.1, 41

[56] References Cited

U.S. PATENT DOCUMENTS

| | | | |
|---|---|---|---|
| 2,891,791 | 6/1959 | Chase | 493/432 |
| 2,991,072 | 7/1961 | Dietrich | 493/432 |
| 4,113,243 | 9/1978 | Gregoire et al. | 493/432 |
| 4,345,906 | 8/1982 | Gregoire | 493/432 |
| 4,368,879 | 1/1983 | Hoshi | 493/432 |
| 4,432,746 | 2/1984 | De Haan | 493/432 |

OTHER PUBLICATIONS

"Atlas of Newspaper and Magazine Printing"-FIG. 85.

*Primary Examiner*—Leonidas Vlachos
*Assistant Examiner*—Jerry Kearns
*Attorney, Agent, or Firm*—Frishauf, Holtz, Goodman & Woodward

[57] ABSTRACT

To prevent withdrawal of a sheet adjacent a moving folding blade in a folding blade-type folding apparatus in which a folding blade is carried by a folding blade cylinder, the blade projecting against a plurality of superposed sheets to press them against folding grippers in a folding gripper cylinder, the outermost sheets are pre-punched with windows placed along the fold lines, and the folding gripper cylinder is formed with projecting grippers which extend through the notches formed upon folding to grip the innermost sheet and prevent inadvertent withdrawal thereof upon withdrawal of the folding blade from the notch in the folding gripper cylinder.

13 Claims, 8 Drawing Figures

MULTI-SHEET ROTARY FOLDING APPARATUS, PARTICULARLY FOR ASSOCIATION WITH ROTARY PRINTING MACHINES

The present invention relates to folding apparatus for association to with a rotary printing machine, and more particularly to a structure which is arranged to fold a multiplicity of stacked superimposed sheets utilizing a folding blade connected to a folding blade cylinder, cooperating with a folding gripper cylinder, and which is so arranged that misfeed due to inadvertent withdrawal of the innermost folded sheet upon withdrawal of the folding blade is prevented.

BACKGROUND

Folding apparatus in which a folding blade is carried by a folding blade cylinder to cooperate with a folding gripper cylinder are known and described in the literature, see for example "Atlas des Zeitungs- und Illustrationsdruckes", FIG. 85 ("Atlas of Newspaper and Magazine Printing", see FIG. 85). Folding apparatus of the type described therein are capable of folding a plurality of superposed printed sheets for common transverse folding. A folding blade secured to the folding blade cylinder presses into the uppermost one of the printed sheets along a predetermined transverse fold line to press the sheets into a groove or notch of a fold gripper cylinder, so that the folded sheets can be gripped therein. Upon return of the folding knife, the next adjacent, then innermost sheet might separate from the outer sheets adjacent thereto and follow, at least in part, the return path of the folding blade. Such inadvertent movement of the innermost sheet together with the folding blade substantially interferes with continuous high-speed production.

THE INVENTION

It is an object to so improve folding apparatus that danger of operating interruption due to movement of the innermost printed sheet with the returning or withdrawing folding blade is prevented.

Briefly, the folding apparatus which can be essentially standard, and driven in the usual and customary manner has associated therewith a punching apparatus which is positioned in advance—in the direction of travel of the sheets—with respect to the folding sheet cylinder. The punching apparatus is arranged to cut at least one window in the region of the fold line from those sheets in the stack which, upon folding, will be outer folded sheets. The windows are cut in a position where projecting grippers positioned in the folding gripper cylinders are located so that they can pass through the at least one window of the folded outer sheets to grip the innermost sheet. The innermost sheet, thus, will be held by the sheet grippers and retained in the folding cylinder even upon withdrawal of the folding blade. Other gripper cylinders can be arranged to bear against the outer sheets at positions where no windows have been cut.

The arrangement has the advantage that the innermost printed sheet is separately gripped upon transfer to the folding gripper cylinder, and is thus securely held against inadvertent withdrawal from the remaining printing sheets, outermost with respect thereto, by the returning and withdrawing folding blade.

DRAWINGS

Figure 2:
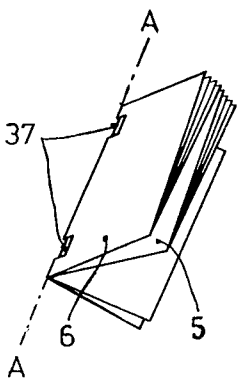
FIG. 2 is a pictorial view of transversely folded printed sheets.

The folding apparatus has two folding formers 1, 2 and feed-in rollers 3, 4 associated therewith. One or more-layered webs 5, 6 which are guided over the folding formers 1, 2 and received from a rotary printing machine schematically shown by block M, are longitudinally folded in the formers 1, 2. The longitudinally folded web 5 is transferred over two tension rollers 7, 8 and a pair of guide rollers 38 to a folding blade cylinder 9. The longitudinally folded web 6 is guided over a pair of tension rollers 10 to guide rollers 11, 12 to the tension roller pair 7 and is so deflected around one of the tension rollers 7 that the two webs 5, 6 are guided, back adjacent back between the guide rollers 38 and the tension rollers 8 to the folding blade cylinder 9.

The folding blade cylinder 9 has three folding blades 39 thereon with well known puncturing needles—not shown. It cooperates with a blade cylinder 13 to sever printed sheets from the webs 5, 6. A printed sheet may include one or more sheets fitted into each other with a common longitudinal fold. The folding blade cylinder 9 additionally cooperates with a folding gripper cylinder 14 which has two movable subdivided folding gripper sets, which cooperate with adjacent fixed folding rails 16. Two such folding gripper sets 15 are shown.

Figure 3:
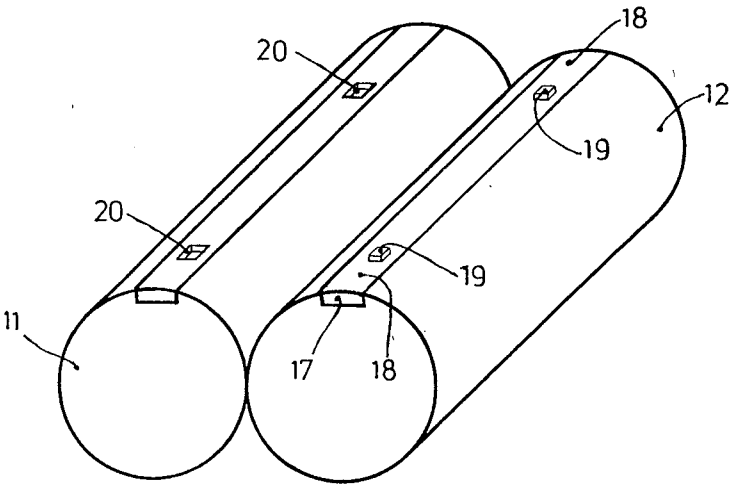
FIG. 3 is a pictorial view of the punch cylinders.

In accordance with the present invention, and as best seen in FIG. 3, a punching arrangement is provided which, for example, utilizes the guide rollers 11, 12. The guide roller 12 is formed with a groove extending parallel to the axis or shaft thereof. The groove is fitted with a strip 17 having punch dies 19 thereon. The strip 17 is secured by screws 18 in the groove of the guide roller 12, in such a manner that the strip can be replaced or removed if the type of production does not permit punching of the web at the folding edge. The strip 17, in the example shown, has two punch dies 19; basically, any number, at least one, of the punch dies are suitable; two or three are preferred. The counter bearing for punching is formed by grooves 20 in strips similar to strip 17 within the roller 11. If necessary, the depressions can be formed in a removable, exchangeable strip in the guide roller 11, as shown, or the depressions can be formed therein for matching suitable dies 19. The diameter of the guide rollers 11, 12 is so dimensioned that its circumference corresponds to the length of one of the sheets which is cut by the knife blade cylinder 13 from the webs 5, 6. The two guide rollers 11, 12 are so driven that their surface speed corresponds to the surface speed of the web 6. The punch dies 19, fitting into the depressions or windows 20, punch out windows 37 from the back edge of the web 6—see FIG. 2. Drive connections, to the extent that they are pertinent to the present invention, are shown schematically by broken lines 100.

As best seen in FIGS. 5 to 8, each one of the folding grippers 15 (FIG. 1) is subdivided. In the example selected, three folding gripper sections 21 are provided, securely attached to a hollow shaft 22, for example by being formed unitary therewith. The hollow shaft 22 is rotatably journalled in the sidewalls 23 of the folding gripper cylinder 14. A control lever 24 is secured to an end of the hollow shaft 22 which extends through the side wall 23. The end of the control lever 22 carries a roller 25. Roller 25 forms a cam follower, cooperating with a control cam 26 secured to the frame (not shown) of the machine. Engagement force of the cam follower roller 25 against the cam curve 26 is obtained by a spring 27, secured between one end of the lever 24 and a counter bearing surface 28 secured to the frame of the machine.

A positioning shaft 29 is located within the hollow shaft 22, freely rotatable with respect thereto. Shaft 29 is formed with two slits, in which folding gripper tongues 30 are inserted. The folding gripper tongues 30 are secured by positioning pins 31. One end of the positioning roller 29 passes through a positioning lever 32. Positioning lever 32 is secured by a clamping screw 33 to the positioning shaft 29. The positioning lever 32 is formed with an elongated or oval hole 34. A positioning screw 35 extends through the elongated hole 35 so that the positioning lever 32 can be shifted with respect to the control lever 34 in various angular positions. This arrangement permits changing of the projection of the folding gripper tongues 30 with respect to the folding flaps 21. The folding rails 16 may be formed with bearing surfaces 36 against which the folding gripper tongues 30 can engage,and which cooperate therewith.

Operation: The punch die 19 forms windows 37 at regular spacing from each other, alongisde the line A—A (FIG. 2) which, later on, will form the transverse fold. Thus, rather than using the guide rollers 11, 12, guide rollers can be used having a circumference which is twice as great, or any other multiple of the length of the sheets which are severed by the cutter cylinders 13. Additional punch die arrangements then can be applied thereto at suitable circumferential locations.

Each one of the printed sheets, severed from the web 6, is at the outside on the folding blade cylinder 9. The web portions which have not been punched, derived from web 5, are at the inside. When the two printed sheets on top of each other, with the predetermined fold line A—A, reach the groove between the folding strips 15 and the folding rail 16, roller 25 will engage in the depression of the control cam 26, to pivot the folding gripper 15 counter the direction of the arrow a in opening position. Immediately thereafter, the folding knife 39 will press the sheets in the space between the folding gripper 15 and the folding rail 16. As soon as the roller 25 leaves the depression of the control cam 26, the folding flaps or grippers 15 will move in the direction of the arrow a, and thus change into closing or gripping position.

In accordance with the invention, the projecting resilient tongues 30 grip through the windows 37 and press the innermost printed sheet from the web 5 against the engagement surfaces 36. Approximately simultaneously, the folding gripper portions 21 grip the outer sheets derived from the web 6 and press them against the folding rail 16. When, then, the folding blades from the folding blade units 39 are withdrawn, the outer printed sheets are held, as before, by the folding gripper sections 21 and the folding rail 16; in addition, however, and in accordance with the invention, the innermost sheets are held in the region of the notches 37 by the tongues 30 in engagement with the engagement surfaces 36 of the folding strip 16. This additional gripping of the inner sheets prevents undesired withdrawal of the inner sheets together with the folding blades.

Figure 1:
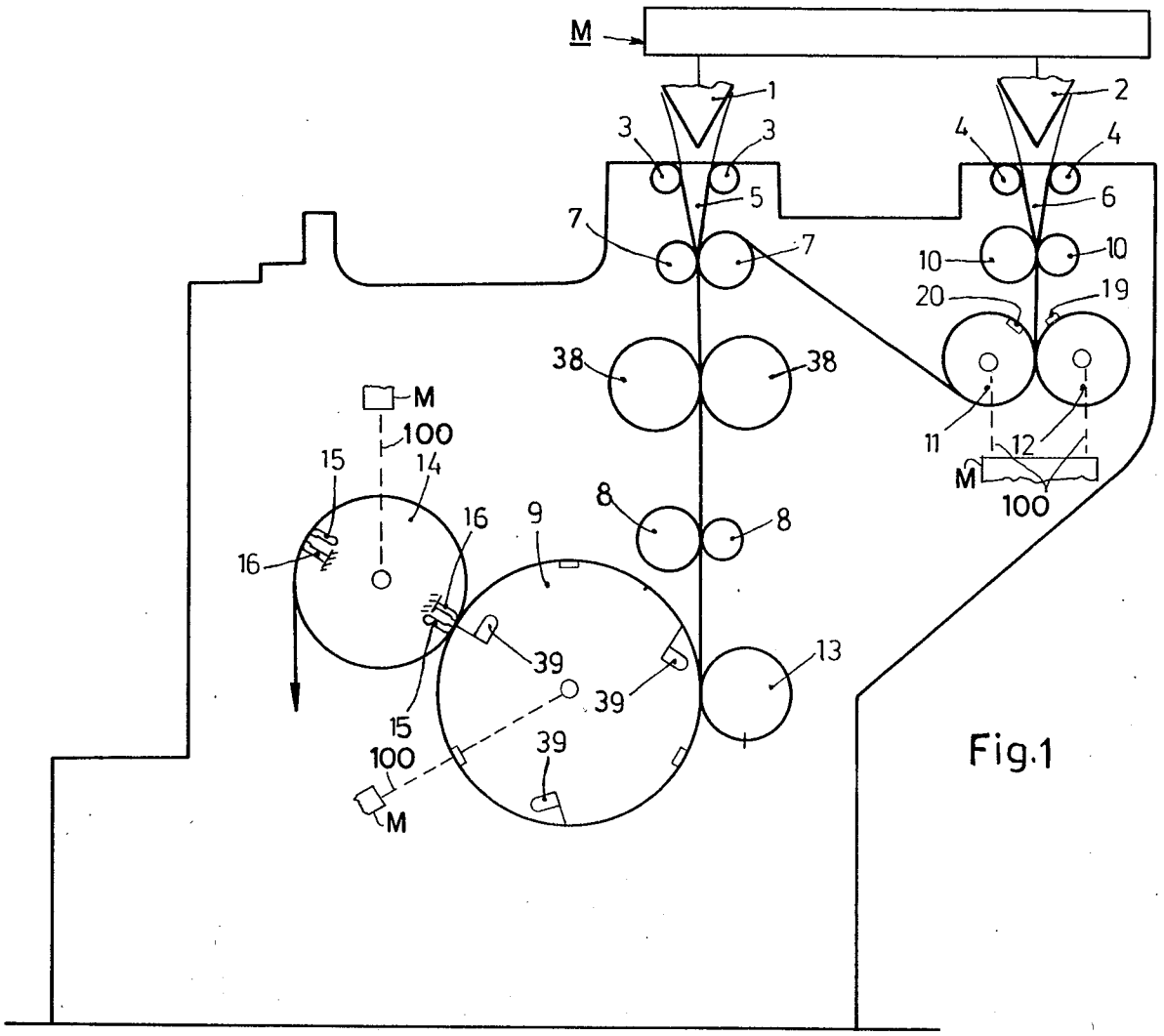
FIG. 1 is a schematic side view of a folding apparatus.

The folding blade cylinder 14 can be constructed with folding grippers 15 and associated folding rails 16; it is, of course, entirely possible to replace the folding strips 16 by a second folding gripper arrangement, arranged as the mirror image with respect to the folding gripppers 15, so that the printed sheets are gripped between two movable folder grippers 15. If one set of grippers 15 is used, the counter surface 26 preferably has a thickness matching the depth of the notches or windows 37 punched out of web 6 by punch dies 19, 20 (FIG. 1).

Figure 4:
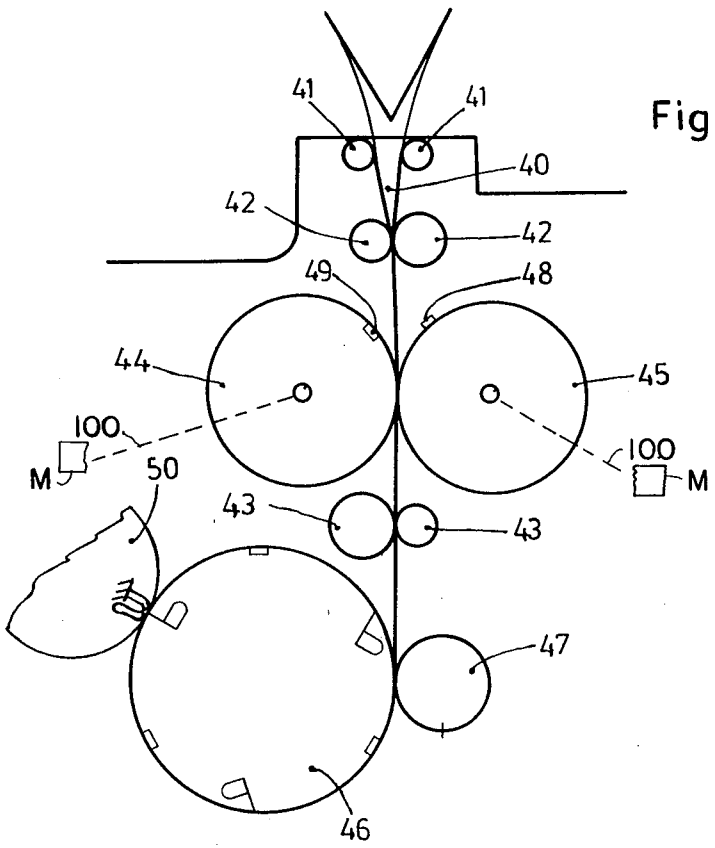
FIG. 4 is a schematic side view of another embodiment.
Figure 5:
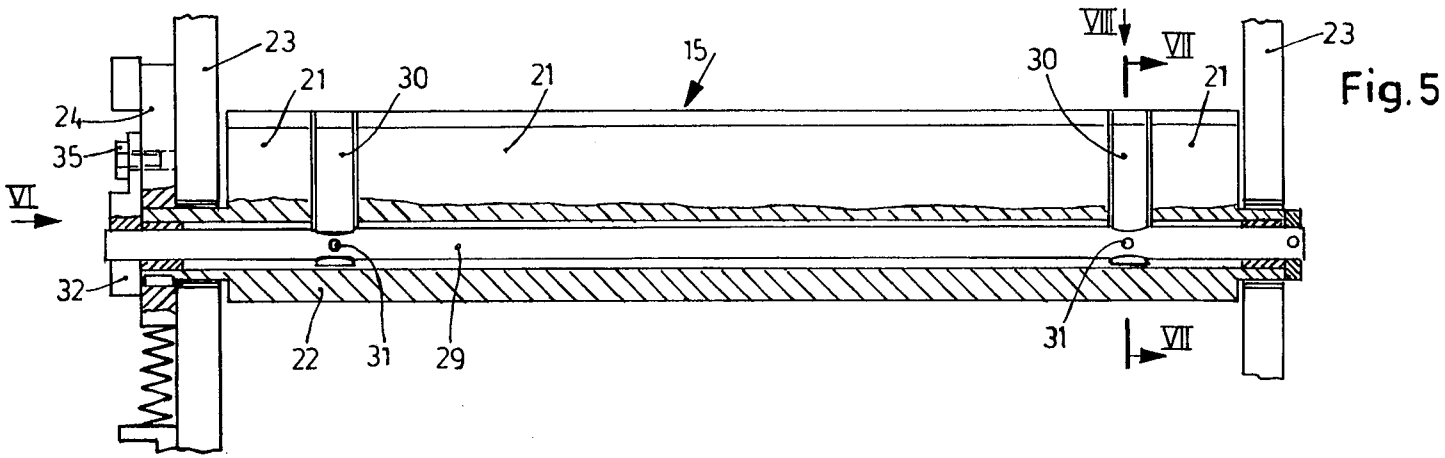
FIG. 5 is a part-sectional, part-top view of a folding gripper arrangement.
Figure 7:
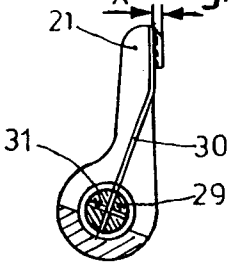
FIG. 7 is a cross-sectional view along line VII—VII of FIG. 5.
Figure 8:
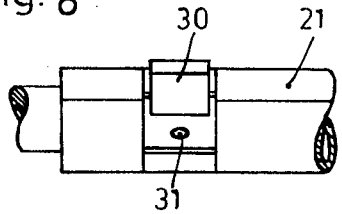
FIG. 8 is a view in the direction of the arrow VIII of FIG. 5.
Figure 6:
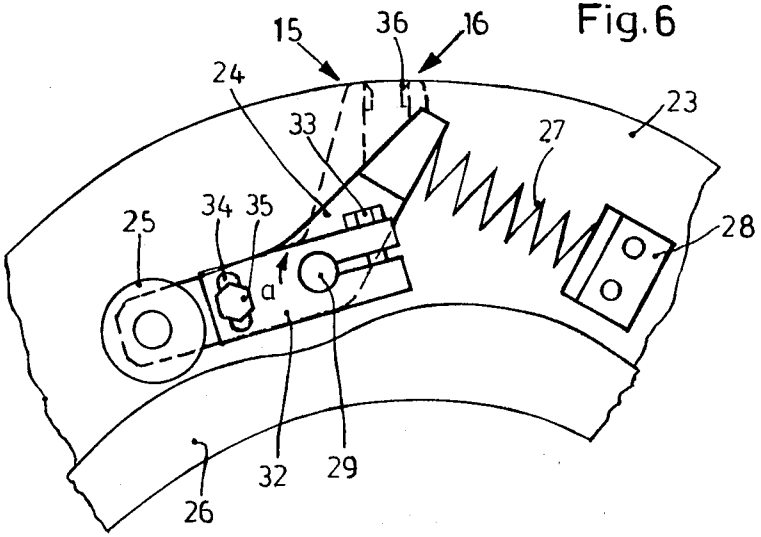
FIG. 6 is a view taken along the direction of arrow VI in FIG. 5 of the folding gripper arrangement.

In the embodiment of FIG. 4, a web set 40 having a plurality of superposed webs is supplied to a folding blade and collection cylinder 46 by input rollers 41, tension rollers 42, 43, as well as driven guide rollers 44, 45 driven from the machine drive as schematically shown by broken lines 100. The folding blade and collection cylinder 46 collects the printed sheets, severed from a continuous web by well known severing or cutter arrangements. Subsequently, the printed sheets are supplied to a folding gripper cylinder 50. Folding gripper cylinder 50 can be constructed identically to the folding gripper cylinder 14 (FIGS. 1–3). In order to insure that the outermost printed sheets are formed with windows through which the grippers can pass, the guide rollers 44, 45 are driven to have have twice the circumference of a printed sheet. The guide roller 45 carries punch dies 48 along a line parallel to the axis of rotation thereof; guide roller 44 is formed with matching punch depressions. Only every other printed sheet is formed with windows along its future transverse fold line. That one of the sheets which later will be at the outer side of the folding blade cylinder is so notched. Rather than using rollers, lever-type rotary carriers may be used to carry the punch dies 48 and the counter surfaces with the depressions 49.

Various changes and modifications may be made, and features described in connection with any one of the figures of the drawings may be used with any of the others, within the scope of the inventive concept.

I claim:

1. Printed sheet rotary folding apparatus, particularly for association with a rotary printing machine having a folding station including a folding blade cylinder (9, 46) and a folding gripper cylinder (14, 50);

means for feeding a plurality of stacked, superposed sheets to the folding station, and comprising, in accordance with the invention, means for preventing sticking of a folded inner sheet on the folding blade including a punch apparatus (19, 20; 48, 49) positioned in advance—in the direction of travel of the sheets—of the folding sheet cylinder (14, 50) arranged to cut at least one window (37) in the region of the fold line from those sheets of the stack which, upon folding, will be the outer folded sheets;

and projecting grippers (30) positioned in the folding sheet cylinder located to pass through the at least one window of the folded outer sheets and gripping the inner sheet, so that the inner sheet will be held by said projecting grippers and retained in the folding cylinder even upon withdrawal of the folding blade;

means for actuating the grippers; and means (100) for coordinately rotating the folding blade cylinder (9, 46) and the folding gripper cylinder (14, 50) and operating the means for actuating the grippers (30).

2. Apparatus according to claim 1, wherein the folding gripper cylinder (14, 50) includes folding gripper sections (21);

and wherein said projecting grippers (30) are formed with means for resiliently deflecting the projecting grippers with respect to said folding gripper sections (21).

3. Apparatus according to claim 1, further including adjustment means (34, 35) adjustably positioning the projecting grippers (30) with respect to the folding gripper cylinder.

4. Apparatus according to claim 2, further including adjustment means (34, 35) adjustably positioning the projecting grippers (30) with respect to the gripper sections.

5. Apparatus according to claim 1, wherein the folding griper cylinder includes folding gripper sections;

and the means for operating the grippers includes a hollow shaft (22) to which the folding gripper sections (21) are secured;

a cam and cam follower (24, 25, 26) controlling opening and closing of the folding gripper sections and controlling rocking of said hollow shaft (33);

a positioning shaft (29) located within the hollow shaft (22), the projecting grippers (30) being secured to the positioning shaft;

and means (32) secured to the positioning shaft (32) and adjustably positioning the positioning shaft with respect to the cam-and-cam-follower arrangement.

6. Apparatus according to claim 5, wherein the cam-and-cam-follower arrangement includes a rocking cam follower (25) and cam lever (24);

and the means adjustably positioning the positioning shaft (29) with respect to the cam lever includes an elongated adjustment opening and a clamping bolt (35) movable within the elongated opening.

7. Apparatus according to claim 1, wherein the punch apparatus (19, 20; 48, 49) comprises a rotary element having at least one projecting die element (19) extending from the circumference thereof;

a second rotary element being formed with a recess die element (20) located to be engaged by the projecting die element.

8. Apparatus according to claim 7, wherein said rotary elements comprise guide rollers (11, 12; 44, 45) having a circumference which is equal to the length of the sheets, or a whole number multiple thereof.

9. Apparatus according to claim 7, wherein said projecting die element includes a replaceable carrier (17) from which the projecting die element (19) extends.

10. Apparatus according to claim 1, wherein the folding gripper cylinder includes a folding strip (16);

and gripper counter surfaces (36) located on said strip in the region of the windows punched into the outer sheets.

11. Apparatus according to claim 10, wherein the gripper counter surfaces (36) have a thickness corresponding to the thickness of the material punched out from the sheets by the punch apparatus.

12. Apparatus according to claim 1, wherein at least one of the projecting grippers (30) fitting into the windows (37) includes a movable element.

13. Apparatus according to claim 12, wherein two oppositely directed projecting grippers are provided on the folding gripper cylinder.

* * * * *